US012325955B2

(12) United States Patent
Nikam et al.

(10) Patent No.: US 12,325,955 B2
(45) Date of Patent: Jun. 10, 2025

(54) ONE STEP DYEING PROCESS OF A POLYESTER/NATURAL FIBER BLENDED FABRIC

(71) Applicant: Dow Global Technologies LLC, Midland, MI (US)

(72) Inventors: Sandeep Nikam, Juinagar (IN); Siddhartha Ghosal, Juinagar (IN); Amit Barun, Mumbai (IN)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 18/684,956

(22) PCT Filed: Dec. 13, 2022

(86) PCT No.: PCT/US2022/052613

§ 371 (c)(1),
(2) Date: Feb. 20, 2024

(87) PCT Pub. No.: WO2023/114156

PCT Pub. Date: Jun. 22, 2023

(65) Prior Publication Data

US 2024/0368832 A1 Nov. 7, 2024

(30) Foreign Application Priority Data

Dec. 16, 2021 (IN) ..... 202141058647

(51) Int. Cl.

| | |
|---|---|
| ***D06P 1/00*** | (2006.01) |
| ***D06P 1/66*** | (2006.01) |
| ***D06P 1/673*** | (2006.01) |
| ***D06P 3/82*** | (2006.01) |
| ***D06P 5/22*** | (2006.01) |

(52) U.S. Cl.

CPC ..... *D06P 1/66* (2013.01); *D06P 1/67341* (2013.01); *D06P 3/8252* (2013.01); *D06P 5/225* (2013.01); *D10B 2201/20* (2013.01); *D10B 2331/04* (2013.01)

(58) Field of Classification Search

CPC ..... D06P 1/66; D06P 1/67341; D06P 3/8252; D06P 5/225; D10B 2201/20; D10B 2331/04

USPC ..... 8/916, 922, 920

See application file for complete search history.

(56) References Cited

U.S. PATENT DOCUMENTS

| | | | | | |
|---|---|---|---|---|---|
| 3,873,265 | A * | 3/1975 | Kleber | D06P 1/0064 | 8/496 |
| 4,629,470 | A * | 12/1986 | Harper, Jr. | D06P 5/22 | 8/185 |
| 4,705,525 | A * | 11/1987 | Abel | C08F 283/06 | 8/918 |
| 4,780,102 | A * | 10/1988 | Harper, Jr. | D06P 3/60 | 8/918 |
| 5,942,011 | A * | 8/1999 | Shirasaki | D06P 1/628 | 8/590 |
| 5,972,045 | A * | 10/1999 | Eggers | D06P 3/54 | 8/922 |
| 6,030,419 | A * | 2/2000 | Strahm | D06P 1/20 | 8/582 |
| 6,537,621 | B1 * | 3/2003 | Kobayashi | C23C 16/34 | 438/653 |
| 7,846,215 | B2 * | 12/2010 | Weber | D06P 3/52 | 8/918 |
| 2016/0319479 | A1 * | 11/2016 | Nikam | C07D 233/16 | |

FOREIGN PATENT DOCUMENTS

| | | |
|---|---|---|
| WO | 2019069116 | 4/2019 |
| WO | 2021158538 | 8/2021 |
| WO | 2021158540 | 8/2021 |
| WO | 2021205475 | 10/2021 |

OTHER PUBLICATIONS

Najafi, One bath method dyeing of polyester/cotton blend fabric with sulphatoethylsulphonyl disperse/reactive dyes treatment by chitin biopolymer, African Journal of Biotechnology, 2009, vol. 8, No. 6, pp. 1127-1135.

Oliveria, Dyeing of cotton and polyester blended fabric previously cationized with synthetic and natural polyelectrolytes, Procedia Engineering, 2017, vol. 200, pp. 309-316.

Shokry, One-bath dyeing of cotton/polyester blend fabrics with chlorophyll dye, International Melliand Textile Journal, 2012, vol. 18.

* cited by examiner

*Primary Examiner* — Eisa B Elhilo

(57) ABSTRACT

The current invention provides methods provides a novel process to dye polyester/natural fiber blends in an all in one step dyeing process. This all in one step dyeing process is enabled by pre-treatment of the fabric using one or more synthetic cationizing agents. The all in one dyeing is then able to be carried out at a lower temperature and a neutral pH, using a combination of disperse and reactive dyes.

6 Claims, No Drawings

ONE STEP DYEING PROCESS OF A POLYESTER/NATURAL FIBER BLENDED FABRIC

TECHNICAL FIELD

The current disclosure pertains to improved processes for the dyeing of a fabric containing polyester fibers and natural fibers (e.g., cotton-based) in which the dyeing is done in a single step.

BACKGROUND

Textile dyeing is the process of applying pigments or dyes on textile materials such as fabrics, yarns, and fibers. Desirably, the dyeing process is efficient and rapid, and provides the dyed textile with a desired degree of coloring, and resistance to fading and running of the dye (color fastness). Further, the dyeing process and the materials used therein preferably do not adversely affect the aspects of the textile, such as its flexibility, durability, and tactile properties like softness, smoothness, stiffness. Depending on the material of the textile (e.g., natural, synthetic, or mixtures thereof) and desired coloring, various dye types are used.

Polyester blends with natural fibers and in particular polyester/cotton blends are important in the textile industry with polyester/cotton blends occupying approximately 60% of the production of all types of the blends in textile industry. Such blends typically require the use of both disperse dyes and reactive dyes, owing to the nature of the different fibers in the blends.

The conventional exhaustion dyeing process for blends with disperse/reactive dyes are of two kinds, 1.) Two-bath method in which the two fibers in the blends are dyed in two independent dyebaths separately with different dyestuffs, and 2.) One-bath-Two-step method, in which the dyestuffs are mixed in a single bath, but the dyeing process is divided into separate steps for each fiber.

In the two-bath method, the polyester part is first dyed using disperse dyes in a first bath, and then the bath is drained. The fabric is then given a reduction clearing treatment wherein it is washed using reducing agent to remove unfixed disperse dyes from the fabric surface. Then in the next bath, the cotton part is dyed using reactive dyes together with salt and soda. The second bath is then drained and the hydrolyzed reactive dye is then removed by washing and soaping. These two baths are therefore independent of one another. The two-bath process are similar to that of pure polyester and pure cotton dyeing.

In the one-bath-two-step method, the disperse and reactive dyes are added together to the dyebath initially. While this method uses a single bath to dye both the polyester and cotton part in the blended fabric, it uses two distinct steps. In the first step the polyester fibers are dyes using relatively high temperatures and a low pH. In the second step, the reactive dye is fixed to the natural fibers using relatively low temperatures and high pH. Accordingly, there is a shift from high temperature low pH from step one to a low temperature high pH required in second step. This change is necessary for facilitating proper disperse dyeing onto polyester at a high temperature, but a lower pH followed by a drop in temperature for the second step. Typically, alkali is added to facilitate fixation of reactive dyes onto cotton part.

The conventional two-bath dyeing method requires long dyeing time which can go up to 9-10 hours of which about 2 hours is devoted to washings and soaping. The longer dyeing cycles also boost the production costs. Moreover, the chemicals used in the reduction clearing process done after the polyester dyeing step have adverse environmental impact.

Though the one-bath two-step dyeing method can be completed in a shorter period of time, there are other challenges. Since both the reactive and disperse dyes are present simultaneously in one bath, each dye much be able to withstand the different dyeing conditions of other dyes. The reactive dye must withstand acidic bath at higher temperature and the disperse dye must have stability to alkaline as well as high electrolyte conditions. Furthermore, it is essential to choose disperse and reactive dyes that do not react with each other or cross stain.

Improved methods for dyeing fabrics or textiles comprising polyester/natural fiber blends is therefore desired.

SUMMARY

The current invention provides methods provides a novel process to dye polyester/natural fiber blends in an all in one step dyeing process. This all in one step dyeing process is enabled by pre-treatment of the fabric using one or more synthetic cationizing agents. The all in one dyeing is then able to be carried out at a lower temperature and a neutral pH, using a combination of disperse and reactive dyes. The process generally involves first immersing the cationized fabric in an aqueous bath comprising a reactive dye and a disperse dye at a temperature in the range of from 80 to 100° C. for a time of from 30 minutes to 60 minutes, where the aqueous bath is at a pH of from 6-7. The dyed fabric is then washed with water at a temperature of from 30-40° C. for at least 20 minutes and then further washed with water at a temperature in a range of from 50 to 70° C. for at least 10 minutes. After this step the fabric is washed with an aqueous solution comprising from 0.5 to 2 grams per liter soap, 1 to 3 grams per liter 50% hydrogen peroxide, and 1 to 3 grams per liter sodium hydroxide at a temperature in the range of from 70 to 90° C. for at least 10 minutes. Next, the fabric is washed with water at a temperature in the range of 50 to 70° C. for at least 10 minutes and then finally washed with an acidic aqueous solution at a temperature in the range of from 30-40° C. for at least 10 minutes.

DETAILED DESCRIPTION OF THE INVENTION

The embodiments of the present invention described below are not intended to be exhaustive or to limit the invention to the precise forms disclosed in the following detailed description. Rather, the embodiments are chosen and described so that others skilled in the art can appreciate and understand the principles and practices of the present invention.

All publications and patents mentioned herein are hereby incorporated by reference to the full extent permitted under the relevant laws. The publications and patents disclosed herein are provided solely for their disclosure. Nothing herein is to be construed as an admission that the inventors are not entitled to antedate any publication and/or patent, including any publication and/or patent cited herein.

The term "about" used preceding any numerical value of the disclosure or appended claims allows some slight imprecision in that stated numerical value, which imprecision may either be understood in the art, or may result from methods of measuring to obtain such numerical values (e.g., such as with chemical or physical measurements), and any numerical value not preceded by the term "about" of the disclosure or appended claims may also be understood the same way.

Methods and compositions of the disclosure described as "comprising" or "including" can include those recited step and compounds, respectively, and optionally can include other steps and components. If methods or compositions of the disclosure are described as "consisting of," those methods or compositions have the recited steps or compounds but do not include steps or compounds that are not recited. The term "consisting essentially of" generally refers to compositions that include the recited compounds and may include other non-recited compounds, but in unsubstantial amounts. For example, such compositions can include one or more other non-recited components but not in an amount that is greater than about 1% (wt), greater than about 0.5% (wt), or greater than about 0.1% (wt), of the total composition. In a composition "consisting of" the recited components there is no other measurable amount of component other than the recited component, or a method "consisting" of certain steps includes no other steps than those ones recited.

For the purposes of the present invention it should be understood that "textiles" includes yarns, fabrics, as well as articles made from fabric or yarns such as garments or linens.

The present disclosure describes a new method of dyeing a fabric comprising polyester fibers and natural fibers, and in particular cotton fibers. The method is suitable for use with fabrics which have been first subjected to a cationization treatment as generally known in the art. Preferred methods of such treatments were recently disclosed in patent applications WO 2021/158538 and WO 2021/158540. These cationization processes can be carried out in a relatively short time period, wherein the process generates low levels of waste and uses minimal energy. The method and system taught in these references treats the textile in an aqueous solution (which can also be referred to as a "padding" solution) that includes an alkali metal hydroxide and a cationizing agent, such as a mono- or di-quaternized nitrogen compound capable of generating one or two epoxide group(s), respectively, in the presence of the alkali metal hydroxide or a halogenated compound capable of generating two epoxide groups in the presence of the alkali metal hydroxide. Preferred cationizing agents include aqueous solutions of quaternary ammonium such those commercially available from Dow under the ECOFAST™ trade name.

In some modes of practice, the padding treatment can be performed quickly, such as in a period of not greater than a minute, and at temperatures, such as ambient temperatures, that does not require heating of the aqueous solution. In some modes of practice, after padding, excess solution is removed from the textile, and then the textile is introduced into a heating apparatus to cause reaction of the cationizing agent with the textile. The heat treatment is also performed rather quickly and in a defined temperature range. In particular, the textile is heated at a temperature(s) in the range of 90° C. to less than 110° C. for a period of time in the range of 1 min to 10 min. In some embodiments more specific temperature and time ranges can be used.

Advantageously, good cationization is achieved without requiring long padding and reaction times (such as periods of time of hours) characteristic of cold batch padding processes. Instead, it has been discovered that the treatment temperatures and times of the disclosure provide good cationization of the textile while minimizing loss of reagent through hydrolysis.

The cationization renders the textile in excellent condition for association with a dye, and the dyeing process can in turn provide good coloration of the textile.

Steps of the method of the invention can be carried out using a continuous process, a semi-continuous process, a batch process, or a combination thereof, as would be generally understood by one of ordinary skill in the art.

One option for processing the textile is using a continuous process. A continuous process is a flow product method that is used to manufacture, process, or produce an article avoiding stoppage of the processing flow. In a continuous process, an article that is being processed or manufactured is in motion. In the continuous processing of a textile, the textile is often in the form of a sheet that is moved through two or more processing areas (e.g., "treatment zone(s)", with the sheet being subjected to different chemical, mechanical, and/or physical processes in each processing area while it is being moved. Movement of the textile in a continuous process can be facilitated by a system apparatus such as a textile conveyor having rollers, which contact and facilitate movement of the textile in a continuous process. A continuous process can be performed on a system of the disclosure as described herein.

In embodiments, two or more steps of the method of the disclosure can be described as a continuous process. For example, in steps of padding the textile in a solution of the base and cationizing agent, mechanically removing a portion of the solution from the padded textile, and then heat treating the textile, the textile can be continuously moved through treatment zones which provide prescribed treatments of the textile in motion. Other steps in the process of dyeing (e.g., washing, neutralizing, and/or optional dyeing) can also be described as continuous, or optionally as non-continuous.

A semi-continuous process can include those wherein a flow product operation (continuous) is stopped and then restarted after a period of time. In some embodiments, two or more steps of the method of the disclosure can be described as a semi-continuous process. For example, depending on desired processing conditions, movement of the textile can be stopped in a treatment zone for a period of time and then restarted to move the textile out of the treatment zone. Methods of the disclosure can use a semi-continuous process wherein movement of the textile is stopped in the heat treatment apparatus for a period of time and temperature described herein suitable for reaction of the cationizing agent with the textile, and then movement of the textile is restarted after the time period to move the textile out of the heat treatment apparatus. A semi-continuous process can be performed on a system of the disclosure as described herein.

Optionally, in embodiments, one or more steps in the method of the disclosure can be performed in a batch process. For example, before a processing step of the disclosure, or after a processing step of the disclosure, the textile can be altered in a way such that it is configured for use in a batch process rather than a continuous process. Alteration may be performed by cutting the textile to provide textile portions which are then used in one or more batch processing steps. In a batch process, the system can include apparatus configured in a way where the textile is not automatically moved from one apparatus to the other otherwise associated with apparatus of a continuous process. For example, in a system that includes apparatus for batch processing step(s), system features such as a conveyor apparatus which otherwise transports the textile from one apparatus to another in a continuous process may not be present in at least some of the apparatus of a system used for batch processing.

In embodiments of the disclosure a cationized textile is provided and then processed according to steps as described herein. The term "textile" refers to a flexible material that includes a network of fibers and that is intended to encompass all forms of textile-based articles, including woven textiles, knitted textiles, and non-woven textiles. Textiles can be in the form of sheets (fabrics) or thin strands (yarns). Textiles can be formed by art-known techniques involving one or more processes of weaving, knitting, crocheting, felting, or braiding strands of fiber-containing materials together. Exemplary textile substrates can be provided in the form of a textile roll which provides a continuous sheet of textile which may have a width of greater than 1 meter and a length of up to 100 meters or more.

Textiles that are cationized for use in the present invention include a natural fiber or derivative thereof. A natural fiber of the textile can be obtained from plants such as cotton, hemp, ramie, flax, jute, kapok, coir, bamboo, and the like. Plant raw fibers can be spun to produce long strands, and the strands can be included in the textile by weaving (interlacing of the strands), knitting (interlooping of the yarns), etc., as known in the art of woven fabrics. In nonwovens, the plant-based fibers are not converted into strands or yarns but are rather directly intermingled with each other or other fibers to produce non-woven fabrics.

The natural fiber in the textile material can include natural polymers such as naturally-occurring polysaccharides like cellulose or cellulosic material, or chitin, or combinations thereof, or derivatives thereof. Cellulose or cellulosic material, which can include modified cellulose, as well as chitin and derivatives thereof, have chemistries that allow reaction with the cationizing agent. Cellulose is composed of repeating glucopyranose subunits which presents three hydroxyl groups on each subunit. Chitosan is composed of repeating glycosamine subunits which presents two hydroxyl groups and one amine group on each subunit. The hydroxyl groups of these polysaccharides are reactive with the hydroxide-activated cationizing agent.

Cellulosic materials also include rayon (viscose), which is generated from wood pulp, and lyocell (e.g., Tencel™), which is a form of rayon. Textile substrates treated according to the disclosure can also include cellulose derivatives such as cellulose acetate, or imidazolidinone-modified cellulose.

Blends of natural fibers are also contemplated for use in this invention and include blends such as wool/cotton blends, silk/cotton blends, and angora/cotton blends.

Textiles that are cationized for use in the present invention will also include polyester fibers.

The cationized textile for use in the present invention preferably has at least about 5% (wt) of a natural fiber such as cotton, or derivative thereof, and more preferably about 25% (wt) or greater, about 35% (wt) or greater, or about 40% (wt) or greater, of the natural fiber (e.g., cellulosic), or derivative thereof. Exemplary blends include a natural fiber (or derivative thereof; e.g., cellulosic)) to polyester fiber weight ratio in the range of about 5:95 to about 95:5, 25:75 to about 25:75, or 40:60 to about 60:40.

The woven textile can also be described in terms of textile weight (weight/area) which is often expressed in terms of ounces per square yard, or grams per square meter. Textile weight can be affected by the type or types of fibers in the textile and their properties, the type of weave of the textile, and the finish of the textile. Exemplary textile weights typically range from about 50 $g/m^2$ to about 450 $g/m^2$, or about 100 $g/m^2$ to about 500 $g/m^2$ or even 400 $g/m^2$.

In embodiments, the process of the disclosure utilizes a cationized textiles that has been bleached, as is generally known in the art. A bleached textile can have removed from it natural color, odor, and impurities otherwise present in when the fiber of the textile is in a raw (natural) form. Oxidative bleaching is typically performed using oxidative bleaching agents such as hydrogen peroxide, sodium hypochlorite, sodium chlorite, sulfuric acid, or a combination thereof. Sodium hydrosulphite is often used for reductive bleaching of textiles.

Once the cationized textile is obtained, the dyeing process is as follows:

a. immersing the cationized fabric in an aqueous bath comprising a reactive dye and a disperse dye at a temperature in the range of from 80° C. to 100° C. for a time of from 30 minutes to 60 minutes, where the aqueous bath is at a pH of from 6 to 7;
b. washing the dyed fabric with water at a temperature of from 30° C. to 40° C. for at least 20 minutes;
c. washing the dyed fabric resulting from step b. with water at a temperature in a range of from 50 to 70° C. for at least 10 minutes;
d. washing the dyed fabric resulting from step c. with an aqueous solution comprising from 0.5 to 2 grams per liter soap, 1 to 3 grams per liter 50% hydrogen peroxide, and 1 to 3 grams per liter sodium hydroxide at a temperature in the range of from 70° to 90° C. for at least 10 minutes;
e. washing the dyed fabric resulting from step d. with water at a temperature in the range of 50° C. to 70° C. for at least 10 minutes; and
f. washing the dyed fabric resulting from step e. with an acidic aqueous solution (for example, at a pH in the range of from 4 to 6) at a temperature in the range of from 30° C. to 40° C. for at least 10 minutes.

In the first step of immersing the cationized fabric in an aqueous bath comprising a reactive dye and a disperse dye, the reactive dye can be any known in the art or combinations of such dyes. "Reactive", or anionic dyes can include one or more anionic groups, such as sulfonate or carboxylate groups. For example, the anionic dye can include one or more sodium sulfonate (—$S0_3Na$) groups. The one or more anionic groups can be present in a dye molecule cable of absorbing light in the visible spectrum and having at least one chromophore/color-bearing group with a conjugated system. Commonly used anionic dyes include those based on azo chemistries, anthraquinone chemistries, and triphenyl methane chemistries. Azo dyes are chemically characterized by the group R—N═N—R', where R and R' commonly include an aryl group, with various chemical substituents attached to the aryl groups. Other anionic dyes include those having nitro chemistries, azine chemistries, and quinoline chemistries. Acid dyes are a type of anionic dyes that can include acid groups such as carboxylic acid, sulfonic acid, or phosphoric acid groups. Anionic dyes that can be used in methods of the disclosure are described in various references, such as Aspland, J. R., (1997) Textile Dyeing and Coloration, American Association of Textile Chemists and Colorists, AATCC; Knutson, L. (1986) Synthetic Dyes for Natural Fiber, Interweave Press; Revised edition. Examples include those dyes named "Reactive," "Direct," and "Acid," preceded or followed by a color name and a number and/or letter, such as "Reactive Blue 19," "Direct Blue 71," "Acid Blue 62," "Reactive Red ME4BL," etc.

In some embodiments, the concentration of the reactive dye in the dyeing solution is in the range of about 0.001 g/L to about 5.0 g/L, about 0.01 to about 2 g/L, with more concentrated dye solutions providing a more intense dye color to the textile.

The disperse dye used in the first step can also be any known in the art, or mixtures thereof. Disperse dye is a category of synthetic dye typically used for polyester and related hydrophobic fibers. Disperse dyes are polar molecules typically containing anthraquinone or azo groups. Disperse dyes are non-ionic in nature and partially soluble in water. In some embodiments, the concentration of the reactive dye in the dyeing solution is in the range of about 0.001 g/L to about 5.0 g/L, more preferably in the range of from about 0.01 to about 2 g/L, with more concentrated dye solutions providing a more intense dye color to the textile The aqueous bath containing the reactive and disperse dyes should be kept at a temperature of from 70° C. to 100° C., more preferably at least 80° C. or even 90° C. during the dyeing step. It is also preferred that aqueous bath be kept at a neutral pH, such as in a range of from 6 to 8, more preferably 6 to 7 or even 6.5 to 7.

The dyeing step can be carried out for a desired period of time, such as in the range of about 30 minutes to about 60 minutes, more preferably in the range of from 35 minutes to 55 minutes or 40 to 50 minutes.

After the dyeing step, the dyed textile is subjected to a first washing step where the textile is washed with water at a temperature of from 20-50° C., preferably 25° C. to 35° C. or even 30° C. to 40° C. for at least 15 minutes, more preferably at least 20 minutes or even 30 minutes.

After the first washing step the dyed textile is subjected to a second washing step where the textile is washed with water at a temperature in a range of from 45° C. to 75° C., preferably from 50° C. to 70° C., or even 55° C. to 65° C. This second washing step is conducted for at least 5 minutes, preferably at least 10 minutes or even 20 minutes.

After the second washing step, the dyed fabric is subjected to soap wash where the fabric is washed with an aqueous solution comprising from 0.5 to 2 grams per liter, preferably from 0.8 to 1.75 grams per liter or even 1 to 1.5 grams per liter of one or more soaps. This aqueous soapy solution also contains 1 to 3 grams per liter of 50% hydrogen peroxide (that is the 50% hydrogen peroxide solution is added in an about so as to result in 0.5 to 1.5 grams hydrogen peroxide per liter of aqueous solution), preferably from 1.5 to 2.5 grams of 50% hydrogen peroxide per liter, or even 1.75 to 2.25 grams per liter. Finally, this aqueous soapy solution also contains 1 to 3 grams per liter sodium hydroxide, preferably 1.5 to 2.5 grams of sodium hydroxide per liter, or even 1.75 to 2.25 grams per liter. The temperature of this soapy bath should be a temperature in the range of from 70° C. to 95° C. more preferably from 75° C. to 90° C. or even 80° C. to 85° C. This soap washing step is conducted for at least 5 minutes, preferably at least 10 minutes or even 20 minutes. The soap used in this step can be any soaping agent known in the art particularly those belonging to the class of anionic wetting agents, such as sulphonates, carboxylates, sulfates and phosphates or combinations thereof.

After the soapy washing step, the dyed textile is subjected to another washing step where the textile is washed with water at a temperature in a range of from 45° C. to 75° C., preferably from 50° C. to 70° C., or even 55° C. to 65° C. This additional washing step is conducted for at least 5 minutes, preferably at least 10 minutes or even 20 minutes.

Finally, the fabric is subjected to a wash with an acidic aqueous solution at a temperature in the range of from 20° C. to 45° C., preferably 25° C. to 40° C. or even 30° to 35° C. This acidic wash is conducted for at least 5 minutes, preferably at least 10 minutes or even 20 minutes. The acid used in this wash can be acids typically used in the industry such as acetic acid and/or phosphoric acid (green acid). The pH of this wash can be in the range of 4 to 6, preferably 4 to 5 or even 4.5 to 5.5.

While the above steps are considered the minimum steps for this process, it should be appreciated that additional steps, including additional washes may be conducted a is generally known in the art.

It should be appreciated that this new dyeing process for textiles made from polyester/cotton (or other natural fibers) blend will improve the productivity of the process by reducing process time to only 4-5 hours and it will also help in saving energy as dyeing can be done at a temperature of less than 100° C. instead of 130° C. typically used to dye polyester textiles.

While other materials not mentioned above can be added to one or more of the steps in the above-described process, as is generally known in the art, it may be advantageous to conduct the process in a manner that is salt free and alkali free. Furthermore, it should be appreciated that dispersing agents may be omitted, and good results still obtained.

The process of the current invention is demonstrated in the following examples.

Example 1

Pre-Treatment of Polyester/Cotton Blend Fabric

Bleached Polyester/cotton fabric (25 gsm) is dipped in an aqueous solution containing fifty grams per liter of an aqueous solution of a quaternary ammonium salt commercially available from The Dow Chemical Company under the trade name ECOFAST™ Pure) and 50 grams per liter of sodium hydroxide. The fabric is passed through this solution through a cold pad batch (CPB) or padding mange with 70% expression (wet pick up). The fabric is then rolled onto a A-Frame and covered with a polyethene sheet for 12-16 hrs. at a temperature of about 25° C.

After this time, the fabric is subjected to a hot wash at 80° C. for 10 min followed by a neutralization process using acetic acid (at a concentration of 1 gram of acetic acid per liter water) at room temperature for 10 minutes. The fabric is s passed through two rollers of a padding mangle with 70% expression (wet pick up) to squeeze the excess solution from the fabric. The fabric is rolled onto a roller and covered with a polyethene sheet for 16 hours.

"All in One" Dyeing Process

A dye bath containing 2% (based on weight of fabric) a reactive dye and 2% of a disperse dye is prepared and heated to a temperature of 40° C. to 50° C. A 5 gram sample of the pre-treated polyester/cotton fabric is added to the bath. The combination of commercially available reactive and disperse dyes stated in Table 1 combination are used for these Examples. Dyeing is carried out in an Infra Red lab dyeing machine with a L:R (liquor ratio or fabric to water ratio) of 1:20 for a period of 40 minutes.

TABLE 1

Dyeing shades developed, and dye combination used

| Ex. No. | Shade | Reactive dyes | Disperse dyes |
|---|---|---|---|
| 1 | Yellow | Reactive Yellow HEXL | Disperse Yellow brown RD2RBNI |

TABLE 1-continued

| Dyeing shades developed, and dye combination used | | | |
|---|---|---|---|
| Ex. No. | Shade | Reactive dyes | Disperse dyes |
| 2 | Red | Reactive Red HEXL | Disperse Rubine RDGFC 1 |
| 3 | Navy | Reactive Navy HEXL | Disperse Navy RDS |

After dyeing, the dyed fabric is subjected to a finishing process as described below:

a) room temperature (25° C. to 30° C.) water wash for a period of 10 minutes;

b) hot (60° C.) water for 10 minutes;

c) soapy water wash with 1 gram per liter soap solution (ACUSOL™-479N, a commercially available solution comprising a copolymer of acrylic acid and maleic anhydride with a molecular weight around 70,000) at a temperature of 80° C. for 10 minutes;

d) hot (60° C.) wash for 10 minutes; and then e) room temperature (25° C. to 30° C.) water wash with acetic acid added to make the pH in the range of from 5 to 7, for 10 minutes.

The pre-treated polyester/cotton fabric dyed with the novel 'all in one' dyeing process can be compared with similar fabric which has not been cationized being dyed with each of the conventional dyeing processes, that is the two-bath process and the one-bath two-step process. The dyeing strength is evaluated using computer color matching software which reports color intensity as a percentage (with the two-bath method using untreated fabric established as the 100% baseline). As shown in Table 2, there is increase in the dyeing strength when the polyester/cotton fabric was pre-treated and dyed using the new 'all in one' dyeing process.

TABLE 2

| Dyeing strength comparison | | | |
|---|---|---|---|
| | Conventional dyeing of untreated fabric | | Cationized-treated |
| Dyes used | Two bath | One- bath Two -steps | and novel 'all in one' dyeing process |
| Yellow | 100% | 130% | 149% |
| Blue | 100% | 112% | 125% |
| Red | 100% | 140% | 175% |

An ISO method (ISP 105C10: C(2)) is used to evaluate the color fastness to washing of the dyed fabrics. In this method, the dyed fabric is sandwiched between two specified adjacent fabrics, that is a cotton sheet and a polyester sheet. Then they are mechanically agitated in an aqueous solution containing 5 grams per liter soap solution (for example ACUSOL™-479N) and 2 grams per liter sodium carbonate ($NaCO_3$) at temperature of 60° C. for 30 minutes, then rinsed and dried. The change in color of the specimen and the staining of the adjacent fabric(s) are assessed with the grey scales and reported in Table 3.

TABLE 3

| Ex. no. | Shade | Dyed Fabric used | Stain on white cotton fabric | Stain on white polyester fabric | Change in colour of dyed fabric |
|---|---|---|---|---|---|
| 1 (comp) | Yellow | Conventional 2 bath | 3 | 4 | 3-4 |
| (comp) | | Conventional one bath 2 step | 3 | 4 | 3-4 |
| (inv) | | Novel 'All in one' dyeing | 4 | 4 | 4 |
| 2 (comp) | Blue | Conventional 2 bath | 3 | 3-4 | 3-4 |
| (comp) | | Conventional one bath 2 step | 3 | 3-4 | 3-4 |
| (inv) | | Novel 'All in one' dyeing | 3-4 | 4 | 4 |
| 3(comp) | Red | Conventional 2 bath | 3 | 3-4 | 3-4 |
| (comp) | | Conventional one bath 2 step | 3 | 3-4 | 3-4 |
| (inv) | | Novel 'All in one' dyeing | 3-4 | 4 | 4 |

As seen from the above experiments, the process of the present invention results in better dying performance while using more environmentally friendly conditions and less overall time.

What is claimed is:

1. A method for dyeing a fabric comprising polyester fiber and natural fiber comprising the steps of:

a. pretreating the fabric with an aqueous solution comprising an alkali metal hydroxide and a cationizing agent, where the cationizing agent comprises either a halogenated compound capable of generating two epoxide groups in the presence of the alkali metal hydroxide or a mono- or di-quaternized cationizing agent;

b. immersing the pretreated fabric in an aqueous bath comprising a reactive and a disperse dye at a temperature in the range of from 80 to 100° C. for a time of from 30 minutes to 60 minutes, where the aqueous bath is at a pH of from 6-7 c. washing the dyed fabric with water at a temperature 30° C. to 40° C. for at least 20 minutes d. washing the dyed fabric resulting from step c. with water at a temperature of 50 to 70° C. for at least 10 minutes;

e. washing the dyed fabric resulting from step d. with an aqueous solution comprising from 0.5 to 2 grams per liter soap, 1 to 3 grams per liter 50% hydrogen peroxide, and 1 to 3 grams per liter sodium hydroxide at a temperature in the range of from 70° C. to 90° C. for at least 10 minutes;

f. washing the dyed fabric resulting from step e. with water at a temperature of 50° C. to 70° C. for at least 10 minutes; and g. washing the dyed fabric resulting from step f. with an aqueous solution at a pH in the range of from 4 to 6 and at a temperature in the range of from 30° C. to 40° C. for at least 10 minutes.

2. A method for dyeing a fabric which has been cationized and which fabric comprises polyester fiber and natural fiber wherein the method comprises the steps of:

a. immersing the cationized fabric in an aqueous bath comprising a reactive dye and a disperse dye at a temperature in the range of from 80° C. to 100° C. for a time of from 30 minutes to 60 minutes, where the aqueous bath is at a pH of from 6 to 7;

b. washing the dyed fabric with water at a temperature of from 30° C. to 40° C. for at least 20 minutes;

c. washing the dyed fabric resulting from step b. with water at a temperature in a range of from 50 to 70° C. for at least 10 minutes;

d. washing the dyed fabric resulting from step c. with an aqueous solution comprising from 0.5 to 2 grams per liter soap, 1 to 3 grams per liter 50% hydrogen peroxide, and 1 to 3 grams per liter sodium hydroxide at a temperature in the range of from 70° C. to 90° C. for at least 10 minutes;

e. washing the dyed fabric resulting from step d. with water at a temperature in the range of 50° C. to 70° C. for at least 10 minutes; and f. washing the dyed fabric resulting from step e. with an aqueous solution at a pH in the range of from 4 to 6 and at a temperature in the range of from 30° C. to 40° C. for at least 10 minutes.

3. The method of claim 2 wherein the cationization of the fabric with an aqueous solution was accomplished by contacting the fabric with a solution comprising an alkali metal hydroxide and a cationizing agent, and where the cationizing agent comprises either a halogenated compound capable of generating two epoxide groups in the presence of the alkali metal hydroxide or a mono- or di-quaternized cationizing agent.

4. The method of claim 2 wherein the pH in steps a. and f. are maintained by the use of acetic acid and/or phosphoric acid (green acid).

5. The method of claim 2 wherein the soap used in step d. is an anionic wetting agent.

6. The method of claim 5 wherein the anionic wetting agent is selected from the group consisting of sulphonates, carboxylates, sulfates, phosphates, and mixtures thereof.

* * * * *